United States Patent [19]

Walter et al.

[11] 4,372,272

[45] Feb. 8, 1983

[54] FUEL DELIVERY SYSTEM WITH FEED AND DRAIN LINE DAMPING

[75] Inventors: Richard P. Walter, Southfield; Lael B. Taplin, Union Lake, both of Mich.

[73] Assignee: The Bendix Corporation, Southfield, Mich.

[21] Appl. No.: 288,728

[22] Filed: Jul. 31, 1981

[51] Int. Cl.[3] ..... F02B 3/00

[52] U.S. Cl. ..... 123/467; 123/450; 123/447

[58] Field of Search ..... 123/467, 447, 446, 450, 123/458, 497, 499, 500, 501, 502, 506; 239/89, 90, 91, 92, 533.5

[56] References Cited

U.S. PATENT DOCUMENTS

| | | | |
|---|---|---|---|
| 2,727,470 | 12/1955 | Ludwig | 123/467 |
| 3,334,679 | 8/1967 | Bruning | 123/467 |
| 3,412,718 | 11/1968 | Long | 123/467 |
| 3,500,802 | 3/1970 | Long | 123/467 |
| 3,500,803 | 3/1970 | Long | 123/467 |
| 3,507,263 | 4/1970 | Long | 123/467 |
| 3,587,547 | 6/1971 | Hussey | 123/447 |
| 4,336,781 | 6/1982 | Overfield | 123/467 |

FOREIGN PATENT DOCUMENTS

| | | | |
|---|---|---|---|
| 2705083 | 8/1978 | Fed. Rep. of Germany | 123/467 |
| 1435462 | 3/1966 | France | 123/467 |
| 2330869 | 3/1977 | France | 123/467 |

*Primary Examiner*—Charles J. Myhre
*Assistant Examiner*—Carl Stuart Miller
*Attorney, Agent, or Firm*—Markell Seitzman; Russel C. Wells

[57] ABSTRACT

A fuel delivery system for a diesel engine for controlling the propagation of unwanted pressure waves including a fuel pump for sequentially delivering fuel from a fuel tank to a plurality of fuel injectors through a plurality of injection lines. The system further includes a drain line, one associated with each fuel injector, that is connected a pressure source, wherein the impedance of each drain line is equal to the impedance of its corresponding injection line. Each drain line further includes a flow restriction having an impedance equal to the impedance of its corresponding drain line and a valve, connected across the flow restriction for diverting flow around the flow restriction during intervals of time when fuel is flowing from the pressure source towards a particular one of the fuel injectors.

17 Claims, 2 Drawing Figures

FUEL DELIVERY SYSTEM WITH FEED AND DRAIN LINE DAMPING

This invention relates to fuel systems for diesel engines and more particularly to fuel systems incorporating fuel injectors having a metering chamber and means for controlling the propagation of unwanted pressure waves.

BACKGROUND AND SUMMARY OF THE INVENTION

One such fuel distribution system as disclosed by Walter et al in U.S. Ser. No. 217,297 filed December 17, 1980, illustrates a fuel system including a plurality of diesel fuel injectors having a metering chamber. Each diesel fuel injector further includes an intensifier piston having a capillary restrictor that is inserted within a fuel passage within the piston. The upper surface of each piston is connected to a pump via an injection or feed line while each metering chamber is connected to, via a drain line, a common manifold and to a secondary source of fuel such as a low pressure fuel accumulator. The pump is of the type that can selectively pressurize the fuel lines to periodically force the intensifier piston downward thereby initiating fuel injection. Thereafter, the pump relieves the pressure within these lines to permit the intensifier piston to move upward and to let fuel flow from the secondary fuel source into the metering chamber thereby premetering or charging the fuel injector with a predetermined quantity of fuel prior to the next injection cycle or event.

Fuel systems such as that disclosed by Walter et al generate pressure waves due to the rapid cycling of hydraulic events. If proper care is not taken to control the line dynamics, the system will not operate efficiently and poor control of the system will result. In addition, because of the common connection of the fuel injectors at the manifold, these systems are subject to cross coupling of pressure waves between the respective drain lines.

The invention is directed to a fuel delivery system having metering and injection modes of operation, for injecting fuel into the combustion chambers of a diesel engine, comprising a fuel reservoir and pump means for extracting fuel from the fuel reservoir and for selectively applying pressurized fuel to one fuel injector of a plurality of fuel injectors and for selectively depressurizing a particular one of the plurality of fuel injectors wherein the pressurizing and depressurizing are performed in correspondence with the combustion process within the engine. The system further includes a plurality of fuel injectors wherein each fuel injector is adapted to inject fuel within the engine, and has a metering chamber for accepting a determinable quantity of fuel prior to delivery of the fuel to the respective combustion chambers of the engine in correspondence with the combustion process therein and a plurality of injection lines interconnecting each of the fuel injectors with the pump means, wherein each injection line is characterized in having a determinable impedance. The system additionally includes pressure source means connected to the fuel reservoir for establishing a pressure level of fuel intermediate the pressurizing and depressurizing pressure levels applied to the plurality of fuel injectors; and drain line means, for carrying fuel between each of the fuel injectors and the pressure source means including a fuel carrying conduit, one associated with each of the fuel injectors, having an impedance equal to the impedance of a corresponding one of the feedlines and, having located therein flow restricting means for restricting the flow therethrough, wherein the flow restricting means has an impedance level to flow nearly equal to the impedance of a corresponding one of the drain lines. In addition, the drain line means further includes valve means, connected in parallel across the flow restricting means, for diverting fuel flow from the flow restricting means during intervals of time when fuel is flowing from said pressure source means towards a particular one of the fuel injectors.

DETAILED DESCRIPTION OF THE DRAWINGS

Figure 1:
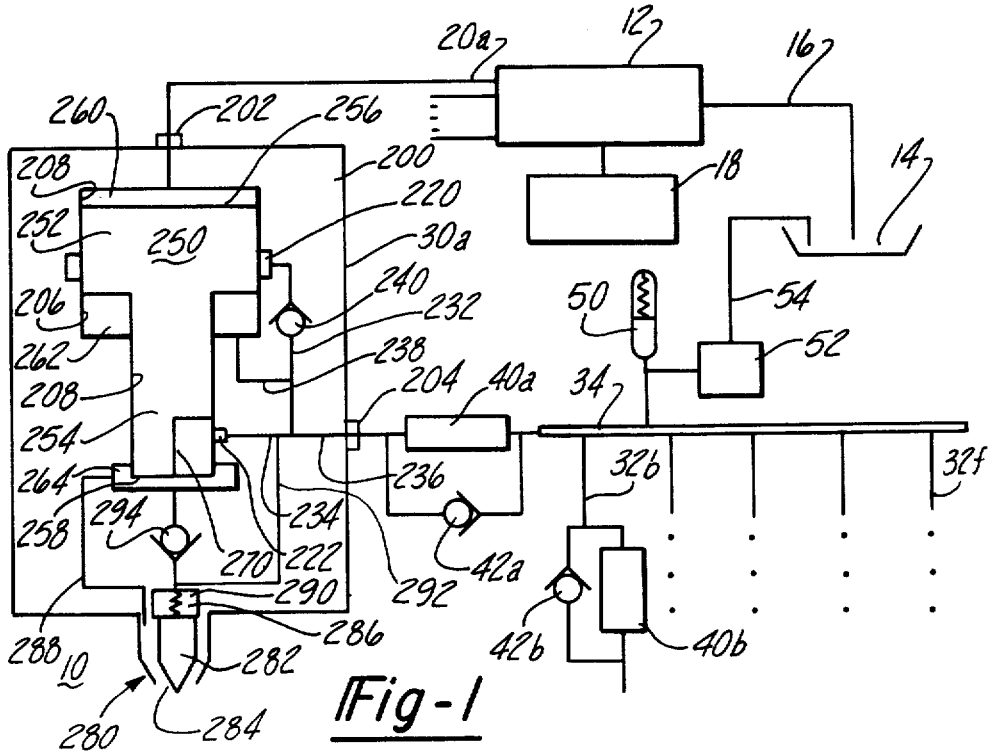
FIG. 1 illustrates a hydraulic block diagram showing a fuel system incorporating the present invention.

Reference is now made to FIG. 1 which illustrates a fuel delivery system incorporating the present invention. More specifically, there is shown a fuel delivery system 10 comprising a distributor pump 12 which removes fuel from the fuel reservoir 14 through the feedline 16 and selectively distributes the fuel, in timed correspondence to the combustion process within a diesel engine (not shown), through a plurality of feedlines 20*a–f* to a plurality of fuel injectors 30*a–f*. Each feedline 20*a–f* is characterized as having a determinable characteristic impedence to fluid flow therethrough. The pump 12 may be controlled by an electronic control unit, ECU 18, of a known variety. One such pump is the dual solenoid distributor pump disclosed by Walter et al. in the commonly assigned patent application U.S. Ser. No. 217,297, filed Dec. 17, 1980 which is expressly incorporated herein by reference. Each injector 30*a–f* is further adapted to receive fuel from a fuel accumulator 50 through a respective one of the drain or metering lines 32*a–f*. Each drain line terminates in the manifold 34. In addition, each drain line 32 *a–f* is characterized as having a determinable characteristic impedance to flow therethrough and in the embodiment of the invention herein illustrated, the equivalent impedance (hereinafter defined) of each drain line 32 is preferably chosen to be approximately equal to the impedence of its corresponding feedline 20. The manifold 34 is connected to the accumulator 50. A relief valve 52 is connected between the manifold 34 and the accumulator 50 to permit excess fluid to flow into the reservoir 14 via the return line 54. Those skilled in the art will appreciate that the accumulator 50 and relief valve 52 may be incorporated within the same unit. Each drain or metering line 32 includes at its end proximate the manifold 34 a terminating device or restrictor 40*a–f* such as a laminar flow restrictor, capillary or orifice. Each restrictor 40*a–f* is chosen such that it presents an equivalent impedance to fluid flow that is equal to the characteristic impedance of its respective drain line 32. A check valve 42*a–f* is preferably placed in parallel with each restrictor 40*a–f* to permit unimpeded flow from the accumulator 50 to each injector 30*a–f*.

Inasmuch as the communication and operation of the distributor pump 12 with respect to each of the fuel injectors 30*a–f* is identical, the following description is directed to the interrelationship between the distributor pump and the fuel injector 30*a*. In addition, where appropriate, the letters designating the plurality of injectors, i.e., letters *a-f*, will not be included in the following discussion. Each injector 30 comprises a housing 200 that is adapted to receive pressurized fuel from a first source such as the distributor pump 12. This pressurized fuel is received at the input or first port 202. In addition, each injector is further adapted to receive pressurized fuel from a second source of pressure such as accumulator 50 at a second port 204. The housing 200 further includes a stepped bore 206 having received therein an intensifier piston 250. The bore 206 and piston 250 cooperate to define an upper, middle and lower variable volume chambers 260, 262 and 264 respectively. The stepped bore 206 comprises an upper first bore 208 and a lower narrower second bore 210. The housing further includes a first dump orifice 220 fabricated within the walls of the upper bore 208. A second dump orifice 222 is fabricated within the walls of the second or lower bore 210 passage. In the preferred embodiment of the invention, the first dump port 220 may comprise an annular cut-out circumscribing the walls of the upper or first bore 208. The first dump orifice 220 is connected to the fluid passages 232 having inserted therein a check valve 240 which is connected to restrict fluid flow from the second port 204 through to the first dump orifice 220. The check valve 240 is also connected to the port 204. The second dump orifice 222 is also connected to the second port 204 through the fluid passages 234 and 236. The middle chamber 264 is connected to the second port 204 through the passages 238 and 236.

The intensifier piston 250 is tightly and reciprocatively received within the stepped bore 206. The intensifier piston 250 includes an upper member 252 and a lower narrower member 254. The upper member 252 contains a pressure receiving surface 256 while the lower member 254 contains another pressure receiving surface 258. As mentioned, the intensifier piston in cooperation with the stepped bore 206, cooperates to provide a number of variable volume chambers such as an upper or primary chamber 260, a lower or metering chamber 264, and a middle or inner chamber 262. The intensifier piston 250 further includes a fluid passage 270 having one end which intersects the pressure receiving surface 258 and another end which terminates at a wall of the lower member 254. The termination of the fluid passage 270 at the wall of the lower member 254 is so configured as to connect the lower or metering chamber 264 to the dump orifice 222 when the intensifier piston 250 moves downward by a determinable amount. The dimensions of the upper member 252 of the intensifier piston 250 are such that the upper pressure receiving surface 256 of the intensifier piston 250 will uncover a portion of the dump orifice 220 at a determinable amount of downward travel thus communicating the upper chamber 260 to the orifice 220.

The injector 30 further includes a nozzle means 280 having a plunger 282 that is reciprocally situated relative to the orifice(s) 284. The plunger 282 is biased during non-injecting periods towards the orifice 284 by the biasing spring 286 to prevent the flow of fluid therefrom. The nozzle means 280 is connected to the lower chamber 262 by a fluid passage 288. The biasing spring 286 is situated within a fluid receiving chamber 290. The fluid receiving chamber 290 is connected to the port 204 via the fluid passage 292 and to the lower chamber through the check valve 294 that is connected to inhibit the flow of fluid from the lower chamber 264 into the fluid receiving chamber 290.

To initiate the injection mode of operation, the pump 12 in cooperation with the ECU 18 will sequentially pressurize the feedlines 20*a-f* therein causing the pressure within a particular upper chamber 260 of a particular injector 30 to rise. This increased pressure will force the intensifier piston 250 downward, therein compressing the fuel within the metering chamber 264 causing it to be injected into its respective combustion chamber in timed sequence with the combustion process therein. As the intensifier piston 250 approaches the bottom of its stroke, the pressure receiving surface 256 will uncover a portion of the primary dump orifice 220 therein communicating the upper chamber 260 with a respective one of the drain lines such as drain line 32*a*. This action thus relieves the pressure within the upper chamber 260 and also provides a path to dump excess pump flow to the accumulator 50. In addition, the fuel passage 270 is communicated with the secondary dump orifice 22. This of course provides a flow passage between the metering chamber and the respective drain line 32*a*. This porting action similarly relieves the pressure within the metering chamber and terminates injection. As mentioned above, when the primary dump orifice 220 is open, the excess flow from the pump will be dumped through to the accumulator 50 via the drain line 32*a*. This dumping of fuel from the upper chamber 260 through to the drain line 32 causes a pressure wave to propagate along the drain line toward the accumulator 50. The utilization of the restrictors 40*a-f* such as a laminar flow restrictor, are sized to be equal to the impedance of its corresponding drain line controls the reflections of this incident pressure wave.

Prior to the next injection mode or cycle of a particular injector, the intensifier piston 250 must be caused to move upward and fluid transmitted from the accumulator 50 into a respective metering chamber 262. The metering of fuel into a metering chamber 262 is accomplished as follows. The pump 12 causes a feedline 20 to be connected to the fuel reservoir 14, thus reducing the pressure therein. The dropping of the pressure creates a rarefaction wave in a feedline 20. Recall that at this point in time the intensifier piston 250 is at the bottom of its stroke and that the primary orifice 220 is open.

In order to cause the intensifier piston 250 to begin its upward travel rapidly, a check valve 240 has been inserted in circuit between each drain line 32 and corresponding primary dump orifice 220. The check valve 240 impedes the flow of fluid from the drain line back into the primary orifice causing the fluid flow to enter the metering chamber 264 and the inner chamber 262, thus causing the piston to move upward. Consequently, the check valve 240 provides a means for obtaining a maximum upward acceleration for the intensifier piston. If speed of response is not a factor in the particular application, the check valve 240 may be eliminated. With the check valve 240 eliminated, the intensifier piston 250 will of course start moving upward, but with a slower acceleration, therefore, the beginning of the metering mode will be slightly delayed and the metered quantity of fuel received in the metering chamber 262 will be slightly less for a given period of time.

Because of the rarefaction wave arriving from the pump to start metering, the direction of fuel flow during the metering mode is from the accumulator 50 toward a particular injector 30. In addition, to insure that the metering mode of operation starts promptly and that flow from the accumulator 50 to a particular injector 30 is not inhibited, a check valve 42 has been connected in parallel with the restrictor 40. Consequently, during the metering mode of operation, fuel will bypass the restrictor 40 and flow through the check valve 42. However, if a slower initiation of metering can be tolerated the check valve 42 may be eliminated.

The use of common components such as accumulator 50 within diesel fuel delivery systems is not new. These accumulators provide a ready source of fuel and may provide pressure regulation. However, in the configuration of the present fuel system, if each drain line 32 is terminated at the accumulator 50 as taught by the prior art, the system operation would be greatly degraded. As an example, during the termination of the injection mode, when the intensifier piston is at the bottom of its stroke, the excess flow from the pump is dumped through the primary dump orifice 220 into the accumulator 50. As this excess flow wave approaches the accumulator, the accumulator acts as a zero impedance termination which will characteristically invert the incoming pump flow wave and reflect the flow wave as a low pressure rarefaction wave back down the drain line 32. These low pressure waves cause cavitation within the drain lines which may severely limit the performance and life of the fuel system and introduce cross-coupling with the other injectors 30*b–f*.

The significance of matching the impedances of the components of the system can be seen from the following discussion. As a pressure wave encounters a change in impedance, a reflected wave will occur. This reflected wave may be a positive (pressure) wave or a negative (rarefaction) wave. The magnitude of the reflected wave may be calculated from equation 1.

$$\Delta P_R = \Delta P - \Delta P_A \quad (1)$$

where $\Delta P$ is the transient pressure change just upstream of an impedance mismatch.

$\Delta P_A$ is the magnitude of the pressure change due to the incident pressure wave.

$\Delta P_R$ is the magnitude of the pressure change due to the reflected pressure wave.

The relationship between the incident pressure wave $\Delta P_A$ and the resulting pressure $\Delta P$, just upstream of the impedance mismatch can be shown to be a function of the impedances before and after the mismatch and is given by equation 2.

$$\Delta P/\Delta P_A = 2/[(Z_o/Z_t)+1)] \quad (2)$$

where $Z_o$ is the upstream line impedance.

The equivalent impedance $Z_E$ of a device, as seen by the fluid flow is the sum of the impedances at the device $Z_D$ plus the downstream impedance $Z_T$:

$$Z_E = Z_D + Z_T \quad (3)$$

As an example: the characteristic impedance $Z_o$ of laminar devices such as long lines or a laminar flow restrictor is linearly related to changes in flow rate $\Delta Q_A$ and pressure $\Delta P_A$ where:

$$\Delta Q_A = \Delta P_A / Z_o \quad (4)$$

$$Z_o = \gamma c / gA \quad (5)$$

and where $\gamma$ is the specific weight of the fluid, c is the speed of sound in the fluid, g is the acceleration due to gravity, and A is the flow area.

Consequently, it can be seen that by maintaining the impedance of the drain line 32 equal to the impedance of its corresponding feedline 20 and further by inserting within the drain line a resistor 40 having an impedance which is equal to that of the impedance of the drain line 32 reflections of the rarefraction wave, which is generated upon reducing the pressure in the feedline, is eliminated and compression waves which are generated by dumping the excess flow of the pump to the accumulator 50, during the injection mode of operation are also controlled. In addition, the repeatability of injector performance is enhanced.

Figure 2:
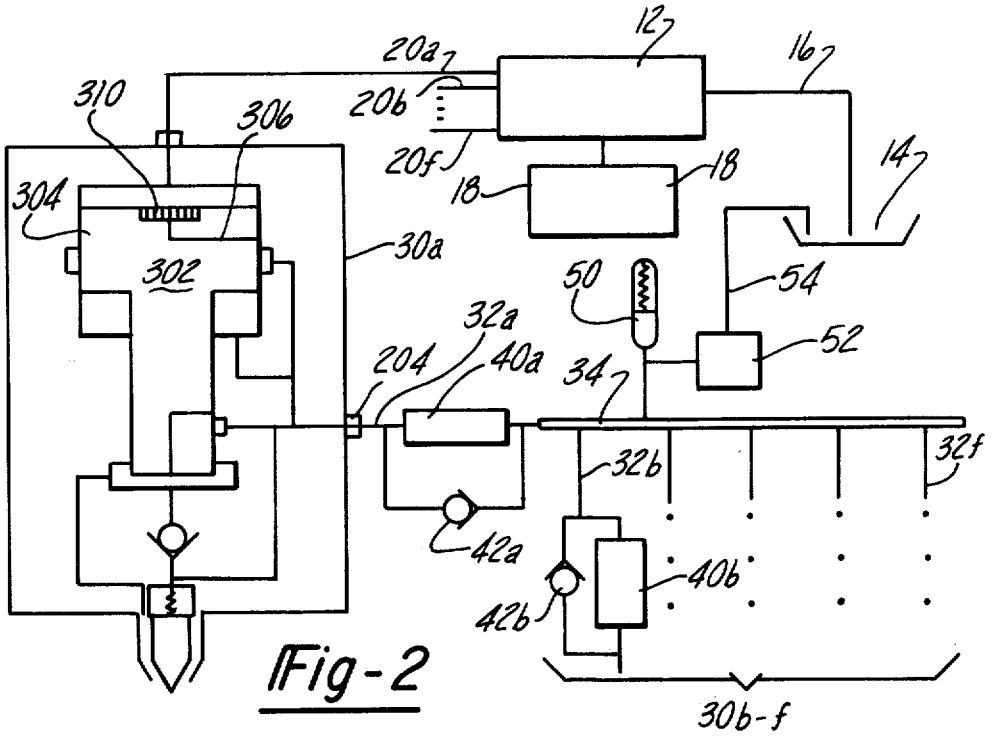
FIG. 2 illustrates another hydraulic block diagram illustrating another embodiment of the invention.

Reference is now made to FIG. 2 which illustrates an alternate embodiment to the invention. From an inspection of FIG. 2, it can be seen that its general structure is similar to that of the fuel delivery system illustrated in FIG. 1, with the exception of the fuel injector 300. More specifically, the fuel injector includes a piston 302 having an upper member 304, with a fuel passage 306 inserted therein a capillary such as the liminar flow restrictor 310. The reciprocating motion of the piston 300 within its cooperating housing 200 causes the flow passage 302 to open and close the primary dump orifice 220. It must be kept in mind that an object of the present invention is to control the magnitude of the reflective pressure waves propagating within the system, as well as to ensure that the piston 302 is accelerated rapidly upward at the beginning of the metering mode of operation. In order to dampen and otherwise control the reflections in the pressure lines, it is required that the impedance of this system measured looking into the laminar flow restrictor 310 toward the accumulator must equal the impedance of the feedline 20. As an example, if the impedance of the laminar flow restrictor 310 is chosen to equal one half the characteristic impedance of a particular feedline 20, then it follows that the impedance of the drain line must similarly be chosen such that it equals the difference between the characteristic impedance of the feedline 20 less the impedance of the laminar flow restrictor 310. In this example, if the impedance of the laminar flow restrictor 310 is chosen to be one half that of the impedance of the feedline 20, then the impedance of the drain line 32 is equal to the impedance of the laminar flow restrictor 310. Having now defined the impedance of a particular drain line 32 to be one half the characteristic impedance of the imput line, it is now necessary to properly terminate the drain line. It is therefore required that the impedance of the restrictor 40 be chosen, as before, be equal to the impedance of its corresponding drain line. Consequently, in this example, the impedance of the restrictor 40 will similarly be chosen to be equal to one half of the impedance of its corresponding feedline. It can be seen therefore, that for a given value of the impedance of a feedline 20, a family of relationships between the value of the impedance of the laminar flow restrictor 310, the impedance of a particular drain line 32 and the impedance of a particular restrictor 40 can be obtained. It can also been seen that the following relationship must hold, that is, the sum of the impedance of the capillary 310 and the drain line 32 must be almost equal to the pump feedline 20. Also, the impedance of the capillary 40 must be approximately equal to the drain line impedance 32.

In the above embodiment, by requiring that the impedance of the drain line 32 be equal to one half of that of the characteristic impedance of the input line, it can be shown that the diameter of the drain line is V2 times larger than the diameter of the feedline. It should be apparent from the above discussion that as the impedance of the drain line increases its allowable diameter will decrease. Similarly, as the impedance of the drain line increase the required impedance of the laminar flow restrictor 310 will decrease. However, if the impedance of laminar flow restrictor 310 is too small, a sufficient pressure drop will not be created thereacross during the beginning of the metering mode of operation, this is, when fuel is flowing from the accumulator 50 and hence, the acceleration of the intensifier piston 300 in an upward direction will be lessened.

The operation of the system illustrated in FIG. 2 is similar to the operation of the system in FIG. 1. It should be noted, however, that during the metering mode of operation, that is when the pressure within the feedline is reduced substantially, the rarefaction wave produced will propagate through the capillary or laminar flow restrictor 310 and through the primary dump orifice 220 without reflection. As the intensifier piston moves in an upward direction metered flow is taken directly from the drain line 32 and some fluid will pass through the restrictor 310 until flow is cut off by the closing of the dump orifice 220. At this point, all of the fluid flowing through the drain line is used for metering.

A third embodiment of the invention can be obtained by eliminating the check valves 42 that have been illustrated in FIG. 2. This is accomplished as follows. The capillary or laminar flow restrictor 310, which is located within the intensifier piston 300 may be chosen to have an impedance which is a small fraction of the impedance of the injection line. In addition the laminar flow restrictor 40 which is lodged within the drain line 32, may be chosen to have an impedance which is a much larger fraction of the line impedance 20. As an example, the laminar flow restrictor 310 can be chosen to have an impedance of from 80 to 90 percent of line 20, while the impedance of the restrictor 42 can be between 10 to 20 percent of the injection line impedance. The obvious advantage of this approach is that a possible six check valves can be eliminated from the system design, thus simplifying the hardware requirement and lowering the system cost.

It is also possible to not use check valves 42, if sufficient accumulator pressure is available to compensate for the pressure drop across the capillary 40 which could be 100 psi. This is true for configurations in both FIGS. 1 and 2.

Having thus described the invention, what is claimed is:

1. A fuel delivery system having metering and injection modes of operation, for injecting fuel into the combustion chambers of a diesel engine, comprising:

a fuel reservoir;

pump means for extracting fuel from said fuel reservoir and selectively applying pressurized fuel to one fuel injector of a plurality of fuel injectors during an injection mode and for selectively depressurizing, during a metering mode, a different one of said plurality of fuel injectors wherein said pressurizing and depressurizing are performed in correspondence with the combustion process within the engine;

a plurality of fuel injectors wherein each fuel injector is adapted to inject fuel within the engine, and has a metering chamber for accepting a determinable quantity of fuel prior to delivery of said determinable quantity of fuel to the respective combustion chambers of the engine in correspondence with the combustion process therein;

a plurality of feedlines interconnecting each of said fuel injectors with said pump means, wherein each feedline is characterized as having a determinable impedance;

pressure source means for establishing a pressure level of fuel intermediate the pressurizing and depressurizing pressure levels applied to said plurality of fuel injectors and for supplying said determinable quantity of fuel to each of said metering chambers; and drain line means, for carrying fuel between each of said fuel injectors and said pressure source means including a fuel carrying conduit, one associated with each of said fuel injectors, having an impedance equal to the impedance of a corresponding one of said feedlines and, having located therein flow restricting means for restricting the flow therethrough, wherein said flow restricting means has an impedance level to flow nearly equal to the impedance of a corresponding one of said conduits.

2. The system as defined in claim 1 wherein said drain line means further includes valve means, connected in parallel across said flow restricting means, for diverting fuel flow from said flow restricting means during intervals of time when fuel is flowing from said pressure source means towards a particular one of said fuel injectors.

3. The system as defined in claim 2 wherein each of fuel injectors comprises:

a housing having a first port that is adapted to receive pressurized fuel from a particular one of said feedlines, a second port adapted to be connected to said pressure source means and a stepped bore, said housing further including a first dump orifice and a second dump orifice situated on said stepped bore;

intensifier piston means responsive to the pressure differential thereacross for reciprocatively moving within said stepped bore, for providing, in cooperation with said stepped bore a plurality of variable volume fuel chambers such as an upper or primary chamber, a middle or inner chamber and a lower or metering chamber, and for selectively porting the fuel within said upper chamber and lower chamber to said first and said second dump orifices respectively in correspondence with its reciprocative motion;

nozzle means, extending from said housing, and operatively connected, in fluid communication, to said lower chamber, for injecting metered fuel therefrom in correspondence with the motion of said intensifier piston means;

first fuel passage means for connecting said second port with said lower chamber including first check valve means for inhibiting flow of fuel from the lower chamber to said second port;

second fuel passage means for connecting said middle chamber to said second port;

third fuel passage means for connecting said first dump port to said second port including second check valve means for inhibiting the flow therebetween; and fourth fuel passage means for connecting said second dump orifice to said second port.

4. The fuel injector as defined in claim 3 wherein said intensifier piston comprises:

an upper cylindrical member, having a first pressure receiving surface thereon, forming the lower extreme of said upper chamber, said upper cylindrical member attached to a lower cylindrical member, forming the upper extreme of said lower chamber, said intensifier piston means further including passage means for connecting said second dump orifice to said lower chamber and for relieving the pressure therein when said intensifier piston means is at a determinable position within said stepped bore.

5. The fuel injector as defined in claim 4 wherein said first and said second check valve means are check valves.

6. The fuel injector as defined in claim 5 wherein said nozzle means includes orifice means for permitting outflow of fuel therefrom and plunger means for selectively opening and closing said orifice means.

7. The system as defined in claims 1 or 3 wherein said valve means comprises a check valve.

8. The system as defined in claim 7 wherein said pressure source means comprises an accumulator for receiving the excess flow from said pump means.

9. The system as defined in claim 8 wherein said pressure source means further includes a relief valve for returning excess fuel to said fuel reservoir.

10. A fuel delivery system having metering and injection modes of operation, for injecting fuel into the combustion chambers of a diesel engine, comprising:

a fuel reservoir;

pump means for extracting fuel from said fuel reservoir and selectively applying pressurized fuel to one fuel injector of a plurality of fuel injectors and for selectively depressurizing a different one of said plurality of fuel injectors wherein said pressurizing and depressurizing are performed in correspondence with the combustion process within the engine;

a plurality of feedlines connected to said pump means, wherein each feedline is characterized as having a determinable impedance;

pressure source means, for establishing a source of fuel to be metered to each fuel injector;

a plurality of fuel injectors wherein each fuel injector is adapted to inject fuel within the engine, and has a metering chamber for accepting a determinable quantity of fuel from said pressure source means prior to delivery thereof to the respective combustion chambers of the engine in correspondence with the combustion process therein; wherein each of fuel injectors comprises:

a housing having a first port that is adapted to receive pressurized fuel from a particular one of said injection lines, a second port adapted to receive fuel from said pressure source means and a stepped bore, said housing further including a first dump orifice and a second dump orifice situated on said stepped bore;

intensifier piston means responsive to the pressure differential thereacross for reciprocatively moving within said stepped bore, for providing, in cooperation with said stepped bore a plurality of variable volume fuel chambers such as an upper or primary chamber, a middle or inner chamber and a lower or metering chamber, and including a fuel passage for selectively porting the fuel within said upper chamber to said first dump orifice, and further including means for porting said lower chamber to said second dump orifice in correspondence with its reciprocative motion, wherein said fuel passage includes a laminar restrictor having an impedance that is a determinable fraction of the impedance of its corresponding feedline;

nozzle means, extending from said housing, and operatively connected, in fluid communication, to said lower chamber, for injecting fuel therefrom in correspondence with the motion of said intensifier piston means;

first fuel passage means for connecting said second port with said lower chamber including first check valve means for inhibiting flow of fuel from the lower chamber to said second port;

second fuel passage means for connecting said middle chamber to said second port;

third fuel passage means for connecting said first dump orifice to said second port;

drain line means, for carrying fuel between each of said fuel injectors and said pressure source means including a fuel carrying conduit, one associated with each of said fuel injectors having a determinable impedance and having located therein flow restricting means for restricting the flow therethrough, wherein said flow restricting means has an impedance level to flow equal to the impedance of a corresponding one of said conduits wherein the sum of the impedance of a particular one of said conduits and its corresponding laminar restrictor is equal to the impedance of a corresponding one of said feedlines.

11. The fuel system as defined in claim 10 wherein the impedance of said laminar restrictor is chosen to be sufficient to create a pressure differential across said intensifier piston to accelerate said intensifier piston upward at the beginning of said metering mode of operation.

12. The fuel system as defined in claim 10 wherein the impedance of said laminar restrictor is within the range of 80 to 90 percent of the characteristic impedance of its corresponding feedline and wherein the impedance of each fuel carrying conduit is within the range of 10 to 20 percent of the characteristic impedance of its corresponding feedline.

13. The system as defined in claim 10 wherein said drain line means further includes valve means, connected in parallel across said flow restricting means, for diverting fuel flow from said flow restricting means during intervals of time when fuel is flowing from said pressure source means towards a particular one of said fuel injectors.

14. The fuel injector as defined in claims 12 or 13 wherein said intensifier piston comprises:

an upper cylindrical member, having a first pressure receiving surface thereon, forming the lower extreme of said upper chamber, said upper cylindrical member attached to a lower cylindrical member, forming the upper extreme of said lower chamber, said intensifier piston means further including passage means for connecting said second dump port to said lower chamber and for relieving the fuel pressure therein when said intensifier piston means is at a determinable position within said stepped bore.

15. The fuel injector as defined in claim 14 wherein said first check valve mean and said valve means are check valves.

16. The system as defined in claim 15 wherein said pressure source means comprises an accumulator.

17. The system as defined in claim 16 further including a relief valve for returning excess fuel to said fuel reservoir.

* * * * *